United States Patent [19]

Alderman

[11] 4,172,345

[45] * Oct. 30, 1979

[54] INSULATION BAGS

[75] Inventor: Robert J. Alderman, Bradenton, Fla.

[73] Assignee: Butler Manufacturing Company, Kansas City, Mo.

[ * ] Notice: The portion of the term of this patent subsequent to Sep. 13, 1994, has been disclaimed.

[21] Appl. No.: 848,469

[22] Filed: Nov. 4, 1977

Related U.S. Application Data

[63] Continuation-in-part of Ser. No. 832,656, Sep. 12, 1977, which is a continuation-in-part of Ser. No. 648,329, Dec. 8, 1975, Pat. No. 4,047,345, which is a continuation-in-part of Ser. No. 494,097, Aug. 2, 1974, Pat. No. 3,969,863, said Ser. No. 832,656, is a continuation-in-part of Ser. No. 656,642, Feb. 9, 1976, Pat. No. 4,047,346, and a continuation-in-part of Ser. No. 649,911, Jan. 16, 1976, Pat. No. 4,075,807, and a continuation-in-part of Ser. No. 646,648, Jan. 5, 1976, Pat. No. 4,075,806.

[51] Int. Cl.[2] ..... E04B 2/28; E04B 1/80

[52] U.S. Cl. ..... 52/406; 52/407; 52/483; 52/743

[58] Field of Search ..... 52/406, 407, 483, 486, 52/743

[56] References Cited

U.S. PATENT DOCUMENTS

| | | | |
|---|---|---|---|
| 2,264,976 | 12/1941 | Heritage | 52/406 |
| 2,287,400 | 6/1942 | Wells, Jr. | 52/407 X |
| 2,576,698 | 11/1951 | Russum | 52/406 X |
| 3,339,783 | 9/1967 | Gorman | 52/406 X |
| 3,364,639 | 1/1968 | Davenport | 52/407 X |
| 3,513,614 | 5/1970 | Studzinski | 52/478 X |
| 3,729,879 | 5/1973 | Franklin | 52/406 |
| 4,047,345 | 9/1977 | Alderman | 52/407 X |

FOREIGN PATENT DOCUMENTS

| | | | |
|---|---|---|---|
| 2060809 | 6/1972 | Fed. Rep. of Germany | 52/406 |
| 2233058 | 1/1974 | Fed. Rep. of Germany | 52/406 |

*Primary Examiner*—Alfred C. Perham
*Attorney, Agent, or Firm*—Jones, Thomas & Askew

[57] ABSTRACT

Discrete bodies of heat insulation are shaped to fit in the roof structure of an industrial building. The insulation bodies fit in the spaces between adjacent ones of the purlins in the roof and are supported by straps extending through or beneath the purlins or by shaping the insulation bodies to include overhanging side flaps that extend across the upper surfaces of adjacent purlins. The insulation bodies are placed end-to-end between adjacent purlins and run parallel to the purlins. The insulation bodies are constructed, for example, in self-supporting monolithic form or in air impervious bags filled with loose heat insulation material.

8 Claims, 7 Drawing Figures

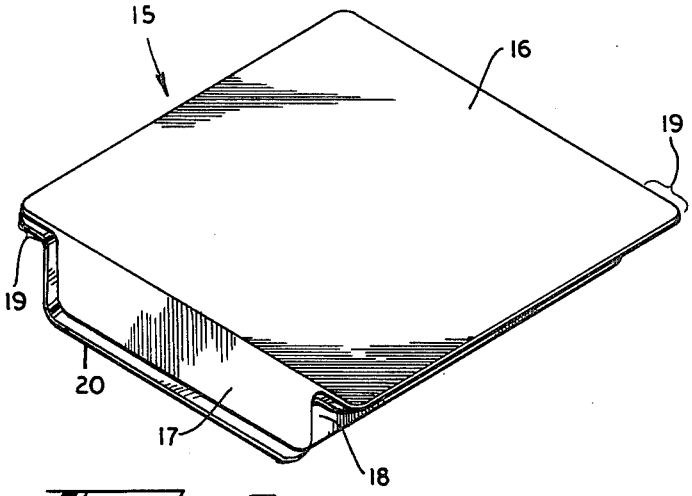
Fig. 3
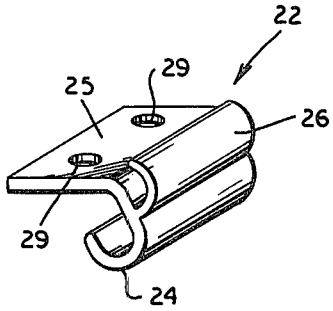
Fig. 5A
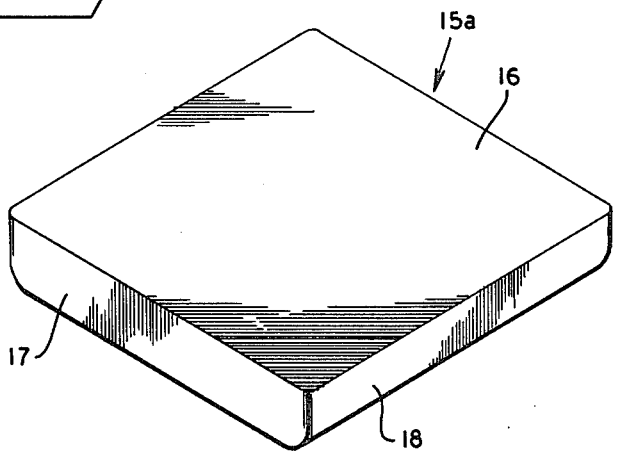
Fig. 4
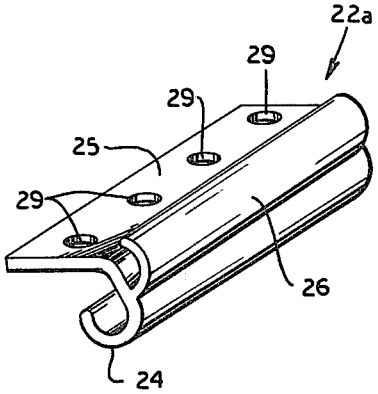
Fig. 5B
Fig. 6
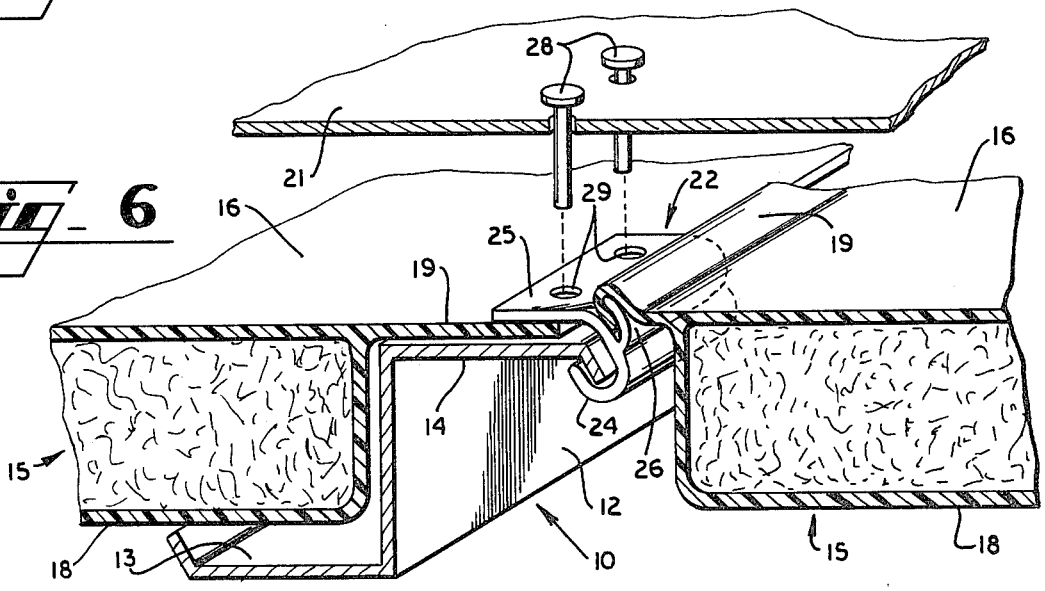

INSULATION BAGS

CROSS REFERENCE TO RELATED APPLICATIONS

This application is a continuation-in-part of application Ser. No. 832,656 filed Sept. 12, 1977, which is a continuation-in-part of application Ser. No. 638,329 filed Dec. 8, 1975, now U.S. Pat. No. 4,047,345, which is a continuation-in-part of application Ser. No. 494,097 filed Aug. 2, 1974, now U.S. Pat. No. 3,969,863. Application Ser. No. 832,656 is also a continuation-in-part of Application Ser. No. 656,642 filed Feb. 9, 1976, now U.S. Pat. No. 4,047,346. This application is also a continuation-in-part of application Ser. No. 649,911 filed Jan. 16, 1976, now U.S. Pat. No. 4,075,807, and is a continuation-in-part of application Ser. No. 646,648 filed Jan. 5, 1976 now U.S. Pat. No. 4,075,806.

BACKGROUND OF THE INVENTION

The roof structure of an industrial building typically comprises rafter beams which extend parallel to one another across the building and slope from the center of the building down toward its sides, and purlins which extend parallel to one another and which extend across and are mounted on the rafter beams. Hard sheets of exterior roofing material extend over and are attached to the purlins.

In the past, when a roof structure of an industrial building was to be insulated, elongated sheets of insulation material were stretched across the purlins and the sheets of hard roofing material were attached to the purlins through the insulation material. The relatively thin sheets of insulation material were applied to the roof structure by the workmen using the sheets of hard roofing material which were already installed in the roof structure as a working surface. Reels of insulation material were first unwound on the hard sheets of roofing material and the long sheets of insulation material were moved by hand over onto the exposed purlins adjacent the hard roofing material and the lengths of the sheets of insulation material extended across the lengths of the purlins. The sheets of insulation material were stretched to prevent sagging between the purlins, and the hard roofing material was then placed over the insulation material and connected to the purlins.

As set forth in my prior U.S. Pat. No. 3,559,914, it has now become common practice to extend the sheets of insulation material along the lengths of the purlins, instead of across the purlins, so as to eliminate the seams between adjacent sheets of insulation material from being exposed inside the building. The new procedure as set forth in my patent has reduced hazards to workmen on the roof by maintaining the reels of insulation material in a relatively static and available position on the exposed purlins without exposing long lengths of a sheet of material to the wind while the workmen remain on the sheets of hard roofing material, so that the occasions when the workmen might be tempted to walk or to climb out on the purlins to place or adjust the sheets of insulation material have been reduced.

SUMMARY OF THE INVENTION

Briefly described, the present invention comprises an insulated roof structure for an industrial building, an improved method for insulating the roof structure of an industrial building and a new configuration of heat insulation material used in insulating a roof structure.

The new configuration of insulation material is a discrete body of insulation which fits between adjacent purlins in the roof structure of an industrial building. One embodiment of the body of insulation is a bag formed of vapor impervious material filled with heat insulation material. The bag is of such a design that it can be fitted down between adjacent ones of the purlins in the roof structure. Since the insulation is self-contained within a bag, it can be easily and quickly applied to the roof structure without the problems created by handling long sheets of insulation material or loose insulation material. The bag functions as a container and is made of an air-impervious material and loose heat insulation material is sealed within the bag so that the bag is ready for use.

The insulation bags can be supported between the purlins by using a lattice of support straps. These straps can extend through slots in the purlins or the straps can extend beneath the purlins and the insulation bags rest on top of the straps. The insulation bags can also be supported in the roof structure by building into the bag a side edge portion of flap which protrudes from the bag on two opposite sides. These side edge portions extend over the adjacent purlins and are attached to the purlins. In this way the side edges support the bag which hangs down from the side edges into the space between the adjacent purlins.

In one embodiment of the invention, the side edge portions of the insulation bags, which extend over the upper portions of the purlins, overlap the side edge portions of similar insulation bags extending between the next pair of adjacent purlins. The side edge portions of the bags are held in place by fastening the metal roofing panels to the purlins. These side edge portions can also be held to the upper portions of the purlins by an adhesive or by special clamps.

Another embodiment of the invention also includes bonding together abutting ends of insulation bags supported between the same two adjacent purlins.

In other embodiments of the invention the discrete body of insulation is a self-supporting shape, such as a self-supporting container filled with heat insulation material or insulation material in a monolithic form.

Thus it is an object of this invention to provide an improved insulated roof structure wherein insulation in a discrete body formed in the shape of the spaces between adjacent ones of the purlins in a roof structure can be quickly and easily installed in the roof structure.

Another object of the invention is to provide bodies of insulation that are formed and sized to fit between and be supported by adjacent pairs of parallel purlins in an industrial roof structure.

Other objects, features and advantages of the present invention will become apparent upon reading the following specification, when taken in conjunction with the accompanying drawings.

BRIEF DESCRIPTION OF THE DRAWINGS

FIG. 3 is a perspective view of a bag of insulation usable with the structure illustrated in FIG. 1.

FIG. 4 is a perspective view of a bag on insulation usable with the structure illustrated in FIG. 2.

FIG. 5A is a perspective view of a bag hanging clip according to the invention.

FIG. 5B is a perspective view of a bag hanging clip similar to FIG. 5A, but illustrating a second, longer embodiment of the clip.

FIG. 6 is a partial perspective illustration of a roof structure, similar to FIG. 1, illustrating how the insulation bags are held in the roof structure by the bag hanging clip.

DETAILED DESCRIPTION

Figure 1:
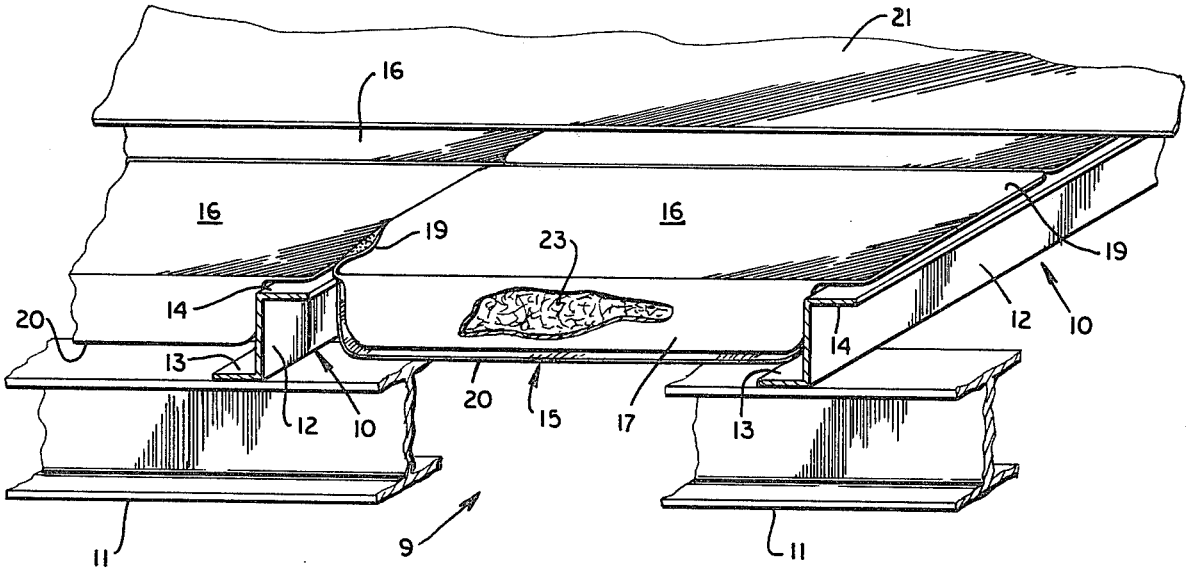
FIG. 1 is a partial perspective illustration of a roof structure, according to the invention, showing how the bags of insulation are supported in the roof.
Figure 2:
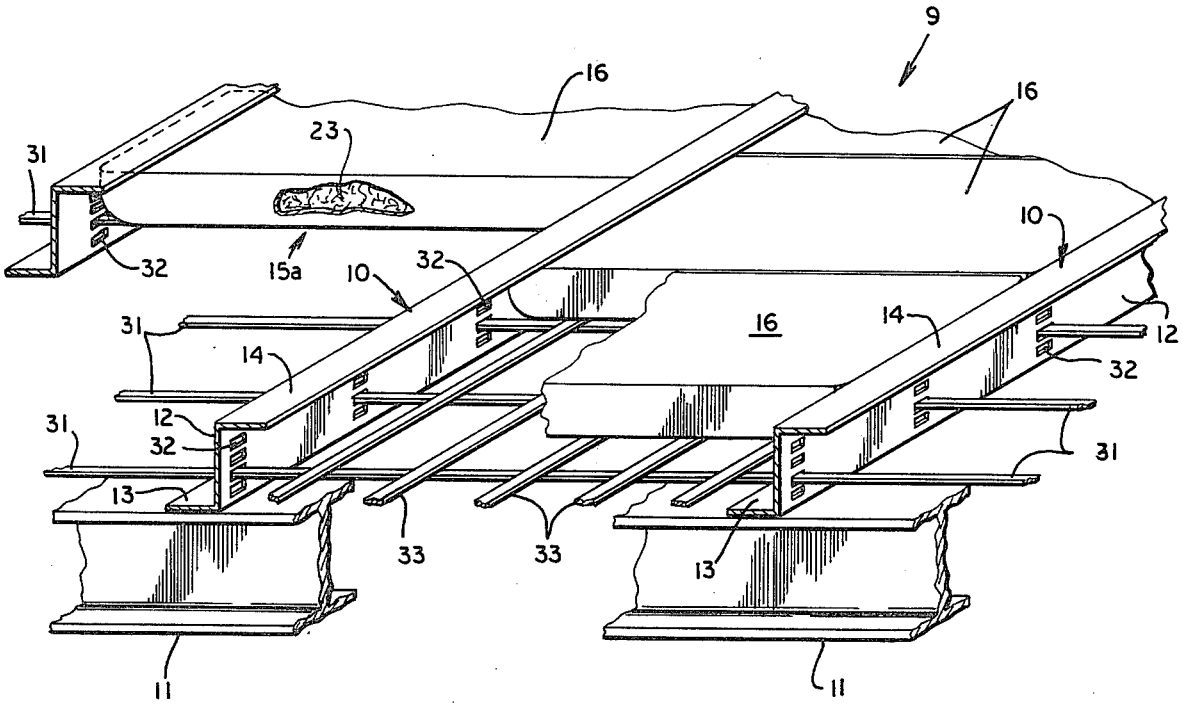
FIG. 2 is a partial perspective illustration, similar to FIG. 1, but illustrating a second embodiment of the invention.

Referring now in more detail to the drawings, in which like numerals indicate like parts throughout the several views, FIGS. 1 and 2 illustrate the roof structure 9 which includes a plurality of spaced parallel purlins 10 mounted on rafters 11. The purlins 10 each include an upwardly extending central web 12, laterally extending lower flange 13 and laterally extending upper flange 14. FIG. 1 illustrates the insulation bags 15 of FIG. 3 being supported between aadjacent ones of the purlins and FIG. 2. illustrates the insulation bags 15*a* of FIG. 4 being supported in a different manner between adjacent ones of the purlins.

One embodiment of the present invention is shown in FIG. 3 as comprising insulation bags 15 each including a top sheet 16, end sheets 17 and bottom sheet 18. Bag 15 includes side edge portions or flaps 19 which protrude in opposing directions from opposite sides of the insulation bag 15. In the embodiment of the bag shown in FIG. 3, an end protruding flap 20 is formed as an extension of bottom sheet 18 and extends between the protruding side edge portions 19 along the lower edge of one of the end sheets 17. The bag is formed from vapor impermeable material and is filled with heat insulation material 23.

The bag embodiment 15 of FIG. 3 is shown positioned in the roof structure in FIG. 1. This insulation bag 15 is supported between adjacent purlins 10 by its protruding side edge portions or flaps 19. The side portions 19 extend over the upper extending flange 14 of the purlins 10. The top sheet 16 of the bag 15 extends tauntly across the space between adjacent purlins 10 while the bottom sheet 18, along with the insulation 23 filling the inside of the bag 15, hangs between the central webs 12 of adjacent purlins 10.

The protruding side edge portions 19 which overlap the upper flanges 14 of purlins 10 are held in place by the fastening of metal roofing material 21 over the top of the side edge portions 19 onto the upper flange 14 of the purlin 10. Another means of fastening the side edge portions 19 to the upper flange 14 is by the use of an adhesive applied between the protruding side edge portion 19 of the bags 15 and the upper flange 14 of the purlin 10. A third way of fastening the protruding side edge portions 19 of the insulation bags 15 to the purlin 10 is to use a bag hanging clip 22 (shown in FIGS. 5A and 5B). Referring to FIGS. 5A, 5B and 6, it can be seen that the bag hanging clip 22 includes a hook shaped edge 24 which surrounds the outer edge of the upper laterally extending flange 14 of the purlins 10; a flat clamping plate 25 which extends over the top of the protruding side edge portions 19 of the insulation bag 15; and a fastening ledge 26. The hook shaped edge 24 is cupped around the purlins upper flange 14 and the clamping plate 25 is brought down on top of the protruding edge 19 thus trapping the edge 19 between the clamping plate 25 and the purlin upper flange 14. The clamping plate 25, and thus the protruding edge 19 of the insulation bag 15, is held in place by placing the metal roofing material 21 on top of the bags 15, clamping plate 25 and protruding edges 19 and subsequently fastening the roofing material 21 to the purlin 10 by using bolts 28 extending through punched holes 29. The protruding edge 19 of the insulation bag 15 and the bag hanging clip 22 can be temporarily held in place by a barb (not shown) extending from the bottom of clamping plate 25. The barb is roughage left from the punching out of holes 29.

The fastening ledge 26 serves to hold one protruding edge portion 19 of an insulation bag 15. The edge portion 19 is tucked behind the fastening ledge 26, as shown in FIG. 6, and the ledge is pressed or bent over the edge portion 19 of the bag 15 thus holding the edge portion 19 tightly. In this way, every insulation bag 15 is supported by its two protruding edge portion 19 one of which is held under the clamping plate 25, as described, and the other edge portion 19 of which is held by the fastening ledge 26 as described. One long bag handing clip 22*a* (as seen in FIG. 5B) can be used in place of two or three short bag hanging clips 22 (seen in FIG. 5A).

The end protruding seam 20 serves as a connector between the first bag and a second bag which is placed in abuttment with the first bag. An alternate method of joining abutting insulation bags 15 would be to simply tape the adjacent bags together, for example, by using a double-faced tape between the ends of the abutting bags (not shown).

Although the bag material is illustrated and disclosed as being flexible, an alternate embodiment of the invention is to form the insulation body in a self-supporting shape so that the insulation body can be hung between adjacent purlins by the flaps 19 resting on the top surfaces of the purlins and suspending the thicker central portions of the insulation bodies down into the spaces between the purlins. This form of the invention can be provided, for example, by forming the bag structure from self-supportive material and filling the bag with insulation material, or by constructing the insulation body in monolithic form such as extruded expanded plastic such as polystyrene.

FIG. 4 shows an alternative embodiment of a discrete insulation body shape according to the present invention. The body shape is provided by insulation bag 15*a* and has no protruding side edge portion 19 to support it from the adjacent purlins 10. Rather the bag 15*a* fits down between the adjacent purlins 10 and is supported on a lattice of support straps running beneath the insulation bags 15*a* as shown in FIG. 2. The supporting lattice includes primary support straps 31 which extend through openings 32 in the central webs 12 of the purlins 10. The support straps 31 are spaced at a distance apart sufficient to provide added support to sagging insulation bags 15*a*. Additional support can be provided to the insulation bags 15*a* by the use of longitudinal straps 33 placed on top of the primary support straps 31 and extending approximately perpendicular to the support straps 31.

A plurality of openings 32 are formed in the central webs 12 of the purlins at different heights so the straps 31 can be positioned higher or lower in the purlin structure by extending the straps through higher or lower ones of the openings. Also, the straps 31 can be extended beneath the purlins, over the rafter beams 11. In this way, the space between the lattice of straps 31, 33 and the hard external sheets of roofing material 21 can be increased or decreased so as to accommodate thicker or thinner bags of insulation material.

As described previously with respect to the insulation body disclosed in FIG. 3, the insulation body of FIG. 4 can be fabricated in a self-supportive form so that it fits more snugly between the purlins and fewer straps or other support devices are required to support the body between the purlins.

It will be understood that the foregoing relates only to disclosed embodiments of the present invention and that numerous changes and modifications may be made therein within the scope of the invention as defined in the following claims.

I claim:

1. A roof structure comprising a plurality of rafters and the like oriented in spaced approximately parallel relationship with respect to one another, a plurality of purlins supported by said rafters in spaced approximately parallel relationship with respect to one another and extending approximately normal to said rafters, each of said purlins including upper and lower surfaces, and an upwardly extending central web, the central webs of said purlins each defining openings therein, a lattice of support straps extending through the openings of the central webs of said purlins at a level between the upper and lower surfaces of said purlins, sheets of hard roofing material and the like supported by the upper surfaces of said purlins, fasteners connecting said sheets of hard roofing material to said purlins, and bodies of heat insulation material suspended between adjacent ones of said purlins, each said body of heat insulation material including side edge portions positioned between the upper surfaces of adjacent ones of the purlins and the sheets of hard roofing material and a central portion of a substantially greater thickness than said side edge portions extending downwardly into the space between adjacent ones of the purlins and resting on the lattice of support straps.

2. A roof structure as claimed in claim 1 and wherein said bodies of heat insulation material each include a top sheet of air impervious material of a width sufficient to allow its opposite side edges to overlie the adjacent parallel purlins, a bottom sheet of air impervious material of a greater width than that of said top sheet, said top and bottom sheets being joined together along their mutual opposite side edges to form said side edge portions of the body of heat insulation material and said top and bottom sheets defining an elongated internal compartment, heat insulation material at least partially filling said internal compartment.

3. The roof structure as claimed in claim 2 and wherein said side edge portions of one body of heat insulation material suspended in the space between one pair of parallel purlins overlaps the adjacent side edge portions of adjacent bodies of heat insulation material which are suspended in the next space between parallel purlins whereby a sealed layer of air impervious insulation material is formed between the sheets of hard roofing material and the purlins.

4. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and oppositely laterally extending upper and lower flanges, the improvement therein of each of said purlins defining groups of openings equally spaced along the length of the purlin through its central web with the openings of the purlins being in approximate alignment with the openings of the purlins on opposite sides thereof, a plurality of support straps oriented parallel to one another and extending through an opening of each group of openings of the central webs of said purlins, bags of insulation material of a width sufficient to substantially span the space between adjacent ones of said purlins positioned between said purlins and resting on said support straps and above the lower flanges of said purlins, and sheets of roofing material mounted on said purlins and extending over said bags of insulation material, said bags of insulation material being of a thickness approximately equal to the height of the space between said support straps and said sheets of roofing material and substantially filling the space between said support straps and said sheets of roofing material.

5. A roof structure comprising a plurality of rafters and the like oriented in spaced approximately parallel relationship with respect to one another, a plurality of purlins supported by said rafters in spaced approximately parallel relationship with respect to one another and extending approximately normal to said rafters, each of said purlins including upper and lower laterally extending flanges, sheets of hard roofing material and the like supported by the upper surfaces of said purlins, fasteners connecting said sheets of hard roofing material to said purlins, bodies of heat insulation material suspended between adjacent ones of said purlins, each said body of heat insulation material including side edge portions positioned between the upper flanges of adjacent ones of the purlins and the sheets of hard roofing material and a central portion of a substantially greater thickness than said side edge portions extending downwardly into the space between adjacent ones of the purlins, and clips attached to the upper flange of each purlin and to the side edge portion of a body of heat insulation material, said clips including one end which is a plate acting as a clamp to hold one side edge portion of an insulation bag between the clip itself and the top edge of the purlins upper flange and a fastening ledge to which an insulation bag in the next adjacent space is attached.

6. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and laterally extending upper and lower flanges, the improvement therein of each of said purlins defining groups of openings through its central web, said groups of openings being spaced along the length of the purlins with the openings of each group being variably spaced from the flanges of the purlins with the openings of the purlins being in approximate alignment with the openings of the purlins on opposite sides thereof, a plurality of support straps oriented parallel to one another and extending through the openings of the central webs of said purlins, bags of insulation material of a width sufficient to substantially span the space between the central webs of adjacent ones of said purlins positioned between said purlins and resting on said support straps and above the lower flanges of said purlins, and sheets of roofing material mounted on said purlins and extending over said bags of insulation material, said bags of insulation material being juxtaposed one another along the lengths of the spaces between adjacent ones of the purlins and being of a thickness approximately equal to the height of the space between said support straps and said sheets of roofing material and substantially filling the space between said support straps and said sheets of roofing material.

7. The roof structure of claim 6 and wherein said bags of insulation material are approximately T-shaped in cross-section with upper oppositely extending side protrusions extending over the upper surfaces of adjacent ones of the parallel purlins and with the central portions extending downwardly between the adjacent parallel purlins and engaging said support straps.

8. A method of applying a roof to a building of the type including inclined parallel rafters and a plurality of purlins with upwardly extending central webs and laterally extending upper and lower flanges mounted on and extending approximately normal to the rafters comprising extending insulation support means through aligned openings in the central webs of adjacent ones of the purlins at a level between the upper and lower flanges of the purlins, placing bags of insulation material on said insulation support means between the purlins and applying hard sheet roofing material to the purlins over the strips of insulation material.

* * * * *